US008974113B1

(12) United States Patent
Chan

(10) Patent No.: US 8,974,113 B1
(45) Date of Patent: Mar. 10, 2015

(54) WEARABLE ASSEMBLY

(71) Applicant: Chung Nam Watch Company Limited, Hong Kong (HK)

(72) Inventor: Siu Ming Raymond Chan, Hong Kong (HK)

(73) Assignee: Chung Nam Watch Company Limited, Hong Kong (HK)

( * ) Notice: Subject to any disclaimer, the term of this patent is extended or adjusted under 35 U.S.C. 154(b) by 0 days.

(21) Appl. No.: 14/226,361

(22) Filed: Mar. 26, 2014

(30) Foreign Application Priority Data

Oct. 29, 2013 (HK) ..... 13112142

(51) Int. Cl.

| | |
|---|---|
| ***G04B 19/10*** | (2006.01) |
| ***G04B 45/00*** | (2006.01) |
| ***G04B 47/04*** | (2006.01) |
| ***A44C 17/02*** | (2006.01) |

(52) U.S. Cl.
CPC ..... *G04B 45/0076* (2013.01); *A44C 17/0208* (2013.01); *G04B 19/10* (2013.01); *G04B 47/044* (2013.01); *G04B 47/042* (2013.01)
USPC ..... 368/285

(58) Field of Classification Search
CPC ..... G04B 19/06; G04B 19/065; G04B 19/10; G04B 39/00; G04B 45/0076; G04B 47/04; G04B 47/042; G04B 47/044
USPC ..... 368/76, 80, 223, 228, 285
See application file for complete search history.

(56) References Cited

U.S. PATENT DOCUMENTS

| | | | | |
|---|---|---|---|---|
| 5,077,709 | A * | 12/1991 | Feher | 368/229 |
| 5,119,350 | A * | 6/1992 | Delacretaz et al. | 368/223 |
| 5,751,667 | A * | 5/1998 | Nunes | 368/223 |
| 6,226,232 | B1 | 5/2001 | Ruchonnet | |
| 6,491,424 | B1 * | 12/2002 | Tardy | 368/283 |
| 6,819,632 | B1 * | 11/2004 | Paul | 368/88 |
| 7,300,202 | B2 * | 11/2007 | Mo | 368/309 |
| 8,096,702 | B2 * | 1/2012 | Grotell et al. | 368/294 |

FOREIGN PATENT DOCUMENTS

| | | |
|---|---|---|
| CH | 609517 A | 3/1979 |
| GB | 2225458 A | 5/1990 |

* cited by examiner

*Primary Examiner* — Vit W Miska
(74) *Attorney, Agent, or Firm* — William J. Sapone; Ware, Fressola, Maguire & Barber LLP

(57) ABSTRACT

A wristwatch is disclosed as including a casing 12 having a first layer 14, a second layer 16 and a base member 18. The first and second layers are spaced apart from each other and are substantially transparent. The base member is spaced apart from the second layer and comprises a dial or a watch movement. At least one movable member 22 is movable relative to the first and second layers between a first position in which an end 24 of the movable member contacts the first layer, and a second position in which the end of the movable member is out of contact with the first layer. At least part of the movable member remains within a recess or a hole 20 of the second layer during movement of the movable member between the first and second positions, so that detachment of the movable member from the second layer is prevented.

14 Claims, 4 Drawing Sheets

WEARABLE ASSEMBLY

CROSS REFERENCE TO RELATED APPLICATION

This application claims priority in Hong Kong patent application no. 13112142.7, filed 29 Oct. 2013, the contents of which are hereby incorporated by reference.

FIELD OF THE INVENTION

The present invention relates to a wearable article which may be worn or carried by a user.

BACKGROUND OF THE INVENTION

In the jewelry or fashion accessory industries, various designs have been made to improve the appearance of wearable articles (such as watches) so as to allow the watches to become more appealing to the wearers. In particular, creative designs, such as inclusion of special features inside the watch bodies or at the watch movements, have been made to watches of all types. However, such features are mostly limited to the surface of the watch movements due to the structure of the common watches, and thus the scope of variation available to a watch designer is also limited.

It is thus an object of the present invention to provide a wearable article in which the aforesaid shortcomings are mitigated, or at least to provide a useful alternative to the trade and public.

SUMMARY OF THE INVENTION

In accordance with the present invention, there is provided a wearable article comprising a casing having a first layer, a second layer and a base member, said first and second layers being spaced apart from each other and being substantially transparent, said base member being spaced apart from the second layer and comprising a dial or a watch movement; and at least one movable member movable relative to said first and second layers between a first position in which an end of said at least one movable member contacts said first layer, and a second position in which said end of said at least one movable member is out of contact with said first layer, wherein at least part of said at least one movable member remains within a recess or a hole of the second layer during movement of said at least one movable member between said first and second positions, whereby detachment of said at least one movable member from said second layer is prevented.

BRIEF DESCRIPTION OF THE DRAWINGS

Wristwatches according to embodiments of the present invention will now be described, by way of an example only, with reference to the accompany drawings, in which.

DETAILED DESCRIPTION OF THE INVENTION

The following description is given by way of example only to illustrate embodiments of the invention. The terminology used is for illustrative purposes only, and is not intended to limit the scope or use of the invention, unless the text clearly and explicitly requires otherwise.

Figure 1:
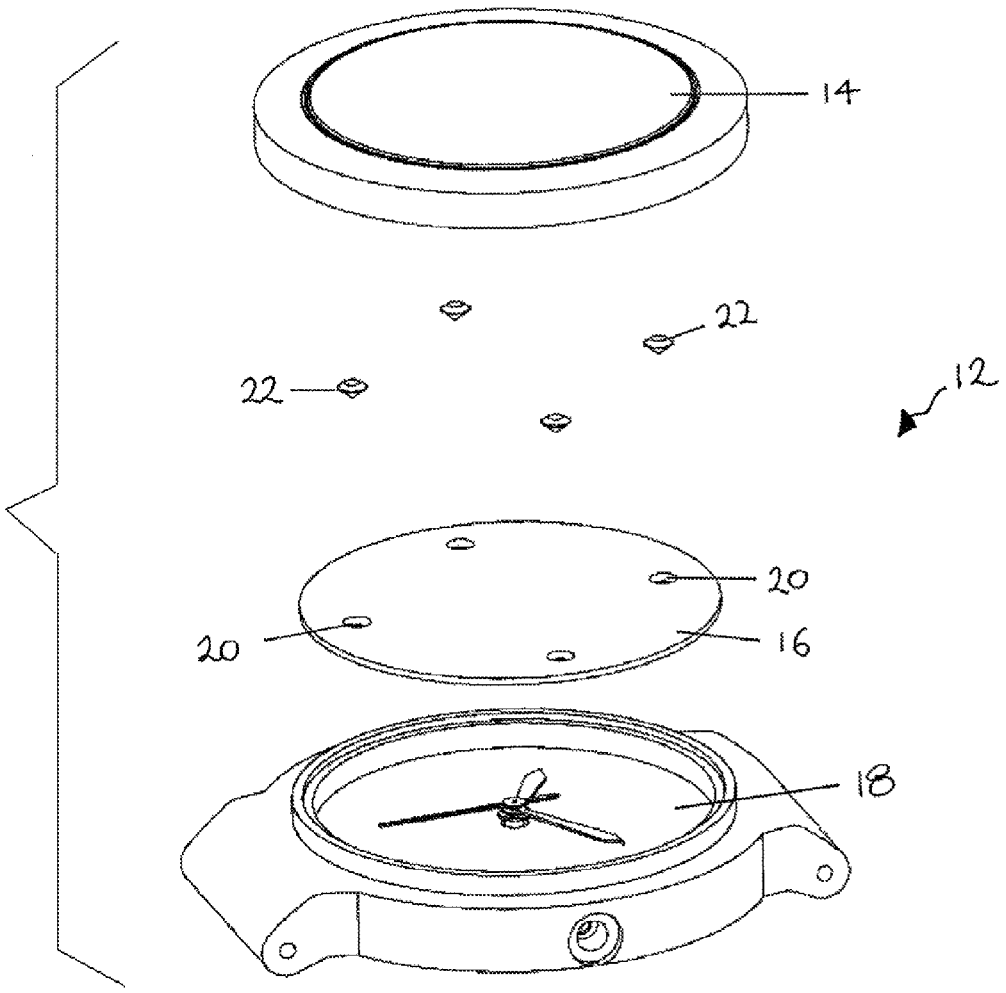
FIG. 1 is a partially exploded perspective view of a watch body of a wristwatch as embodied in a first embodiment of the present invention.

Referring to FIG. 1, a wearable article in the form of a wristwatch as embodied in the present invention is illustrated. For clarity and simplicity, only the watch body is shown in the drawings, with the watchband or watchstrap, which is not substantially relevant to the present invention, omitted in the illustration.

Specifically, the wristwatch comprises a casing 12 having a first layer 14, a second layer 16 and a base member 18. The first layer 14 and the second layer 16 are spaced apart from each other, and are made of substantially transparent materials such as, but are not limited to, glass, crystal or sapphire. In this context, the term "substantially transparent" means that the layers will be sufficiently transparent to allow the base member 18, which may be the dial or the watch movement of the watch, to be clearly visible to show the time, so as to serve the purpose of a watch. Particularly, the first layer 14 can be the outermost transparent layer of the watch body through which the dial or the watch movement is observable by the user.

Figure 2A:
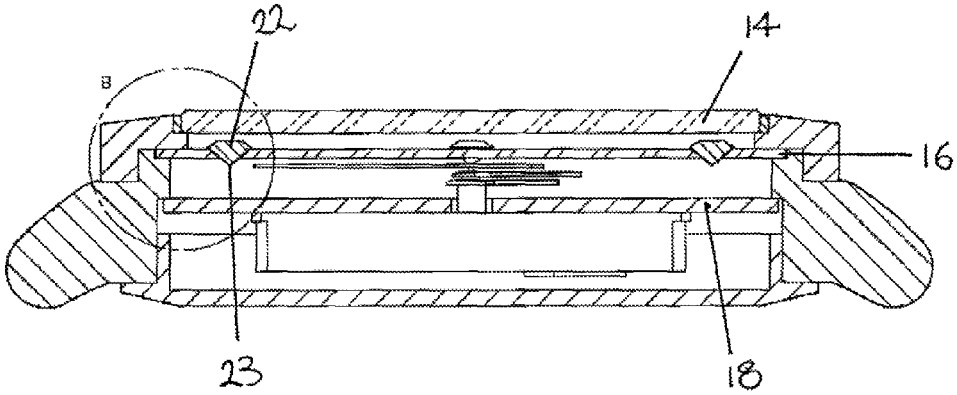
FIG. 2*a* is a cross-sectional view of the watch body of FIG. 1 as assembled.

As shown in FIG. 1, the second layer 16 is provided with a plurality of holes or recesses 20 so that movable members 22, for example decorative elements such as diamonds, gemstones or synthetic stones, can be removably engageable with the holes 20 of the second layer 16. As further illustrated in FIGS. 2*a* and 2*b* (an enlarged view of the region indicated by the circle as shown in FIG. 2*a*), the movable member 22 has a lower extremity 23 which protrudes out of the second layer 16 through the hole 20. The movable member 22 is movable relative to the first layer 14 and the second layer 16 between an upper position in which an uppermost surface 24 of the movable member 22 contacts the first layer 14, and a lower position in which the uppermost surface 24 is out of contact with the first layer 14. In this way, at least part of the movable member 22 remains within the hole 20 of the second layer 16 during movement of the movable member 22 between the upper and the lower positions, and therefore detachment of the movable member 22 from the second layer 16 is prevented. The movable member 22 is thus entrapped between the first layer 14 and the second layer 16, and yet allowing linear reciprocal movement or, more specifically, substantially perpendicular linear reciprocal movement of the movable member 22 between the layers 14 and 16. Particularly, the distance a between the extremity 23 and the upper most surface 24 of the movable member 22 is longer than the distance b between the first layer 14 and the second layer 16.

Figure 2B:
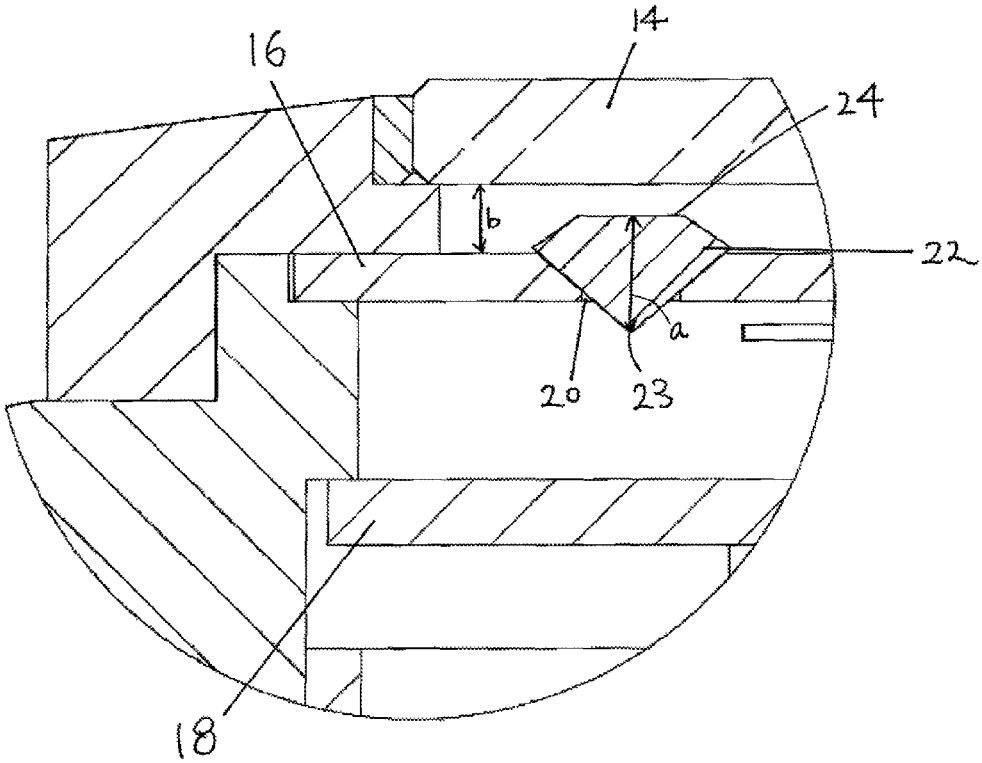
FIG. 2*b* is an enlarged view of the encircled region of FIG. 2*a;*

The hole 20 can be configured as a circular bore extending through the second layer 16. Specifically, the hole 20 may be configured as a conical frustum as shown in FIGS. 1, 2*a* and 2*b*, having slanted, surrounding sidewall to support the lower portion of the movable member 22. Alternatively, the hole 20 may also be configured into any shape or size to accommodate and support the movable member 22, as long as the movable member 22 can be movably retained by the second layer 16. Apparently, in order to provide support to the movable member 22 so that the movable member 22 can remain sitting in the second layer 16, it is important that the hole 20 must not have a dimension larger than the corresponding dimension of the movable member 22, which will thus allow the movable member 22 to pass through and be released from the second layer 16 via the hole 22.

As mentioned above, the movable members 22 can be decorative elements such as but are not limited to diamonds, gemstones, synthetic stones or crystals. Alternatively, the movable members 22 may also be any functional items movable between the first and the second layers 14, 16 in a reciprocal manner.

Figure 3:
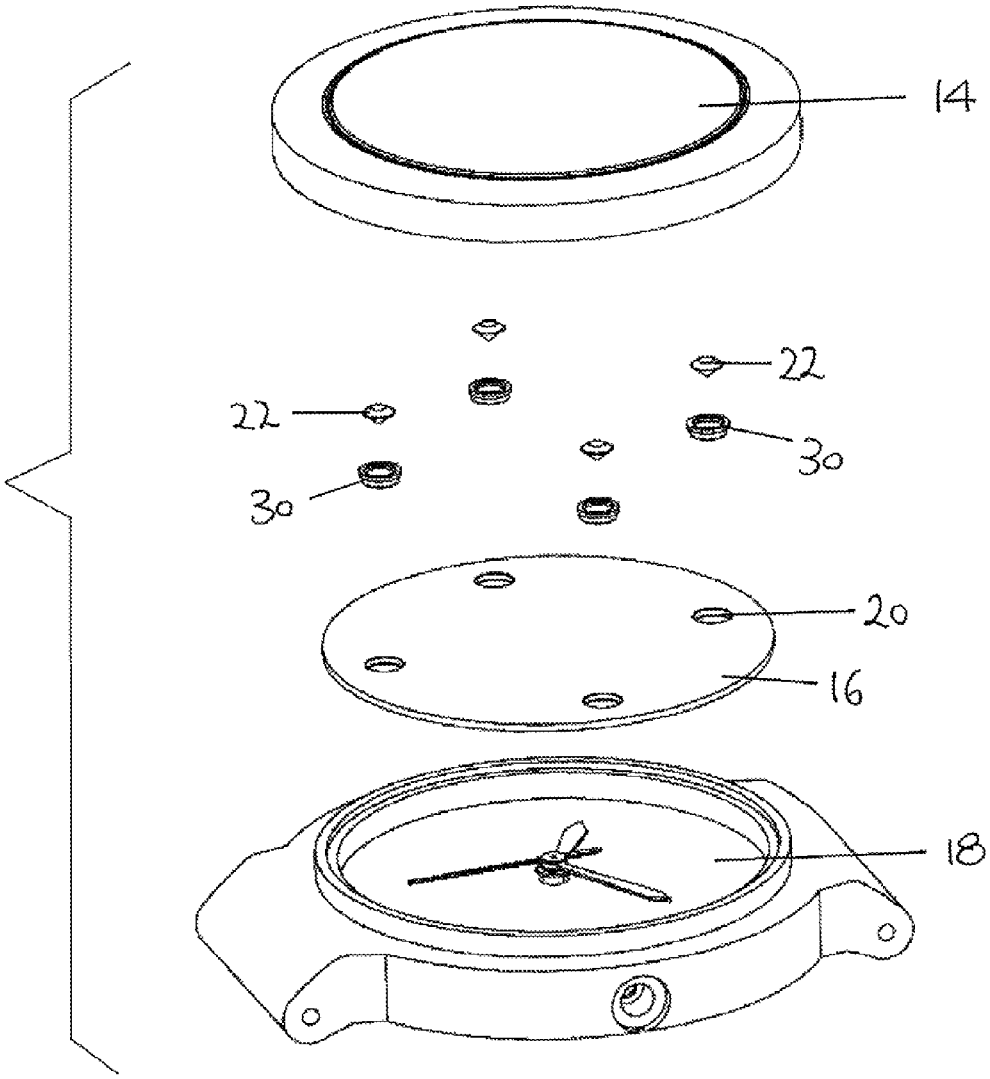
FIG. 3 is a partially exploded perspective view of a watch body of a wristwatch as embodied in a second embodiment of the present invention.
Figure 4A:
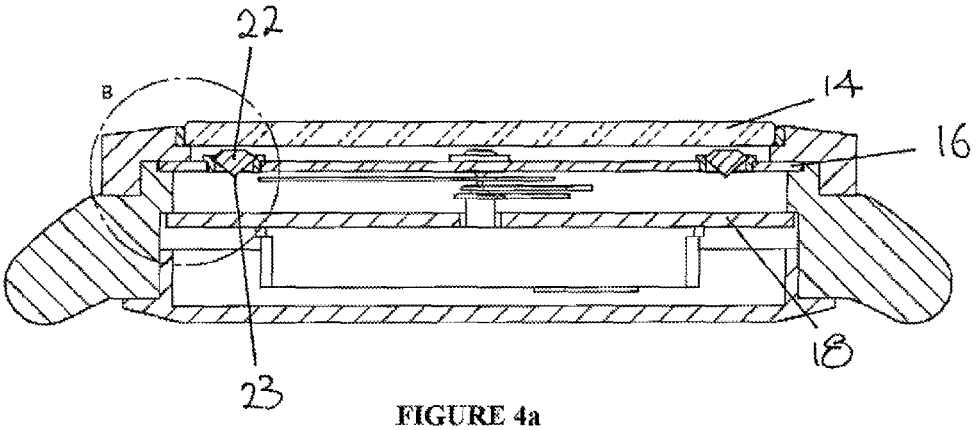
FIG. 4*a* is a cross-sectional view of the watch body of FIG. 3 as assembled.
Figure 4B:
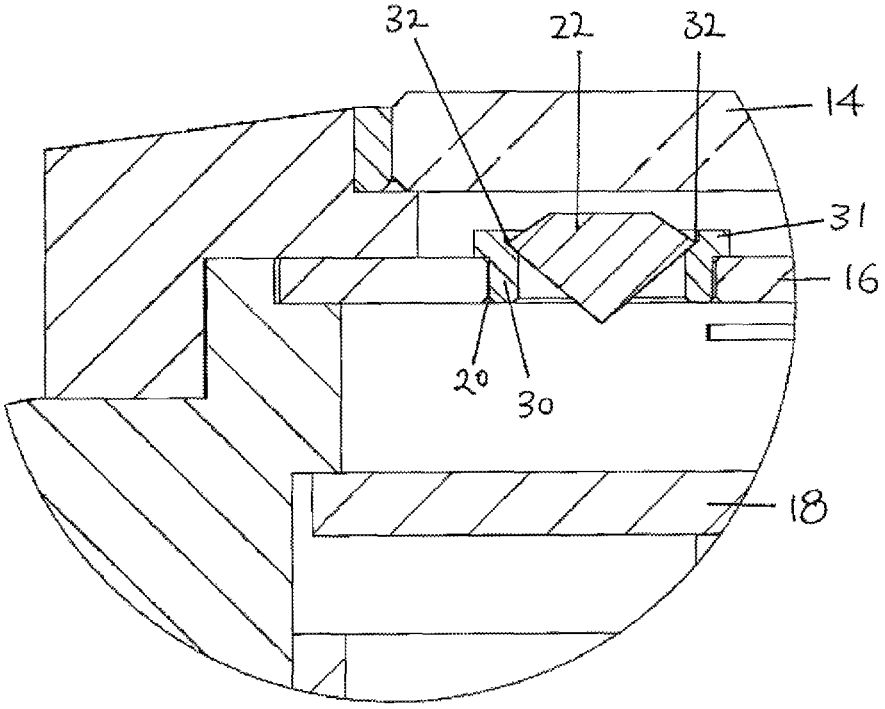
FIG. 4*b* is an enlarged view of the encircled region of FIG. 4*b.*

FIGS. 3, 4*a* and 4*b* illustrate another embodiment of the present invention. In this embodiment, the movable member 22 is removably supported by a supporting element 30 such as a bushing. The supporting element 30 is also adapted to be removably engaged with the second layer 16. As illustrated in the FIGS. 3, 4*a* and 4*b*, the hole 20 may be configured with a cylindrical wall so as to accommodate the cylindrically shaped supporting element 30, and the supporting element 30 may be movably retained on the surface of the second layer 16 by means of a shoulder portion 31. The supporting element 30 can also be arranged with seat portions 32, on which the outer edge of the movable member 22 can be movably seated.

Again, the supporting element 30 can also be configured into any shape or size to accommodate and support the movable element 22, as long as the movable element 22 can be movably retained therein. Similarly, the supporting element 30 should not be limited to any specific configurations, as long as it can be movably retained in the second layer 16.

The supporting element 30 may further be decorated with elements such as diamonds, crystals, gemstones or synthetic stones for a more appealing appearance.

It should be understood that the above only illustrates and describes examples whereby the present invention may be carried out, and that modifications and/or alterations may be made thereto without departing from the spirit of the invention.

It should also be understood that certain features of the invention, which are, for clarity, described in the context of separate embodiments, may also be provided in combination in a single embodiment. Conversely, various features of the invention which are, for brevity, described in the context of a single embodiment, may also be provided or separately or in any suitable sub-combination.

The invention claimed is:

1. A wearable article comprising:

a casing having a first layer, a second layer and a base member, said first and second layers being spaced apart from each other and being substantially transparent, said base member being spaced apart from the second layer and comprising a dial or a watch movement; and at least one movable member movable relative to said first and second layers between a first position in which an end of said at least one movable member contacts said first layer, and a second position in which said end of said at least one movable member is out of contact with said first layer, wherein at least part of said at least one movable member remains within a recess or a hole of the second layer during movement of said at least one movable member between said first and second positions, whereby detachment of said at least one movable member from said second layer is prevented.

2. The wearable article according to claim 1, wherein the at least one movable member is substantially linearly reciprocally movable relative to the second layer.

3. The wearable article according to claim 2, wherein the at least one movable member is movable substantially perpendicular to the second layer.

4. The wearable article according to claim 1, wherein the at least one movable member comprises a first decorative element.

5. The wearable article according to claim 4, wherein the at least one movable member comprises a supporting element for supporting said first decorative element.

6. The wearable article according to claim 5, wherein the first decorative element is removably engaged with the supporting element.

7. The wearable article according to claim 5, wherein the supporting element is removably engaged with the second layer.

8. The wearable article according to claim 5, wherein the supporting element comprises a second decorative element.

9. The wearable article according to claim 1 wherein the wearable article is a wristwatch.

10. The wearable article according to claim 4, wherein the first decorative element comprises a gemstone or a synthetic stone.

11. The wearable article according to claim 10, wherein the gemstone is a diamond.

12. The wearable article according to claim 8, wherein the second decorative element comprises a gemstone or a synthetic stone.

13. The wearable article according to claim 12, wherein the gemstone is a diamond.

14. The wearable article according to claim 1, wherein the recess or the hole is circular.

* * * * *